US005282008A

United States Patent [19]

Ellingham et al.

[11] Patent Number: 5,282,008

[45] Date of Patent: Jan. 25, 1994

[54] MAGNETIC ROLLER CLEANING APPARATUS

[75] Inventors: David J. Ellingham; Peter S. Alexandrovich; Bruce J. Rubin, all of Rochester, N.Y.

[73] Assignee: Eastman Kodak Company, Rochester, N.Y.

[21] Appl. No.: 783,471

[22] Filed: Oct. 28, 1991

[51] Int. Cl.[5] ..... G03G 21/00

[52] U.S. Cl. ..... 355/305; 355/303

[58] Field of Search ..... 355/305, 306, 296, 303; 118/652

[56] References Cited

U.S. PATENT DOCUMENTS

| | | | |
|---|---|---|---|
| 4,279,499 | 7/1981 | Rezanka et al. | 355/305 |
| 4,515,467 | 5/1985 | Suzuki | 355/305 |
| 4,601,569 | 7/1986 | Garris | 355/305 |
| 4,627,717 | 12/1986 | Thompson et al. | 355/305 |
| 4,723,144 | 2/1988 | Silverberg | 355/305 X |
| 5,003,354 | 3/1991 | Takamiya et al. | 355/305 |

FOREIGN PATENT DOCUMENTS

| | | | |
|---|---|---|---|
| 0069676 | 4/1985 | Japan | 355/306 |
| 0257478 | 12/1985 | Japan | 355/305 |
| 0004092 | 1/1986 | Japan | 355/305 |
| 0281185 | 11/1988 | Japan | 355/305 |

*Primary Examiner*—A. T. Grimley
*Assistant Examiner*—Robert Beatty
*Attorney, Agent, or Firm*—Leonard W. Treash

[57] ABSTRACT

A magnetic roller cleaning apparatus for removing residual toner particles from an image-bearing surface in a copier or printer includes a housing and a rotatable magnetic roller for moving a nap of a magnetic cleaning mix in the housing. The cleaning apparatus also includes a detoning roller for removing residual toner particles from the nap being moved by the magnetic roller. The cleaning apparatus further includes a magnetic member mounted externally on the housing and upstream of the detoning roller for mixing a top portion and a bottom portion of the nap on the magnetic roller prior to detoning.

10 Claims, 2 Drawing Sheets

MAGNETIC ROLLER CLEANING APPARATUS

BACKGROUND OF THE INVENTION

Field of the Invention

The present invention relates to cleaning apparatus for removing residual toner particles from a surface in, for example an electrostatographic reproduction machine such as a copier or printer. More particularly, the present invention relates to a magnetic roller-type cleaning apparatus for use in such machines.

Electrostatographic process reproduction machines such as copiers and printers for producing copies of an original document are well known. Such copies typically are produced on suitable receivers through a repeatable process that normally includes the steps of (1) using electrostatic charges in some manner to form a latent image on the surface of an image-bearing member; (2) developing the latent image with developer material that includes toner particles; (3) transferring the developed image to a suitable receiver for fusing; and (4) cleaning the image-bearing surface thereafter by removing residual toner and other particles therefrom in preparation for repeating the process steps.

The quality of the copies obtained by repeating these steps depends significantly on the effectiveness of cleaning devices or apparatus employed for removing the residual particles left on the image-bearing surface after the image transfer step. Such cleaning apparatus include, for example, magnetic roller cleaners as disclosed in U.S. Pat. Nos. 4,723,144 and 4,601,569.

Conventional magnetic roller cleaning apparatus as disclosed, for example, in U.S. Pat. No. 4,601,569 are well known for removing charged residual toner particles from the image-bearing surface. Typically, in such apparatus, a charged magnetic cleaning mix which includes magnetic carrier particles is moved within a housing by a magnetic roller into contact with oppositely charged residual toner particles on the surface being cleaned. The cleaning mix, as is well known, forms a nap on the magnetic roller. The bottom portion of such a nap is on and near the surface of the magnetic roller, and the top portion of such nap is extended radially away from such surface. After the nap makes contact with the surface being cleaned and picks up residual toner therefrom, the magnetic roller then rotates such nap into a detoning relationship with a detoning roller which is mounted spaced radially from the magnetic roller for removing the picked up residual toner particles from the nap.

It has been found that the detoning roller of such conventional apparatus removes residual toner particles mainly from the top portion of the nap on the magnetic roller, and removes very little of the residual toner particles from the bottom portion of such nap. The consequence is undesirable aging of residual toner particles in the bottom portion resulting in an undesirable stratification of cleaning mix properties forming the cleaning nap. Such properties include toner concentration, charge-to-mass ratio of particles, and particle polarity. The net result is ineffective cleaning of the surface and less than desired image quality.

SUMMARY OF THE INVENTION

It is an object of the present invention to provide a magnetic roller cleaning apparatus that overcomes the above problems and disadvantages.

In accordance with the present invention, a magnetic roller cleaning apparatus is provided for removing residual toner particles charged to a first polarity from a surface in an electrostatographic reproduction machine such as a copier or printer. The magnetic roller cleaning apparatus comprises a housing which includes an opening for mounting in proximity to a surface being cleaned. A rotatable magnetic roller is supported within the housing for forming a cleaning nip through the opening with the surface being cleaned. A magnetic cleaning mix for contacting the surface being cleaned in order to attract and remove charged residual toner particles therefrom includes magnetic carrier particles charged to a second polarity opposite to the first polarity of the toner particles. The magnetic cleaning mix forms a cleaning nap having a bottom portion on the surface of, and a top portion extending radially away from, the rotatable magnetic roller. The magnetic roller cleaning apparatus also comprises a charged detoning roller that is mounted adjacent the rotatable magnetic roller for removing attracted residual toner particles from the nap of the magnetic cleaning mix on the magnetic roller, and nap mixing means for disturbing and creating a mixing action between the bottom and top portions of the cleaning nap.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic reproduction apparatus are well known, the present description will be directed in particular to elements forming part of or cooperating more directly with the present invention. Apparatus not specifically shown or described herein are selectable from those known in the prior art.

Figure 1:
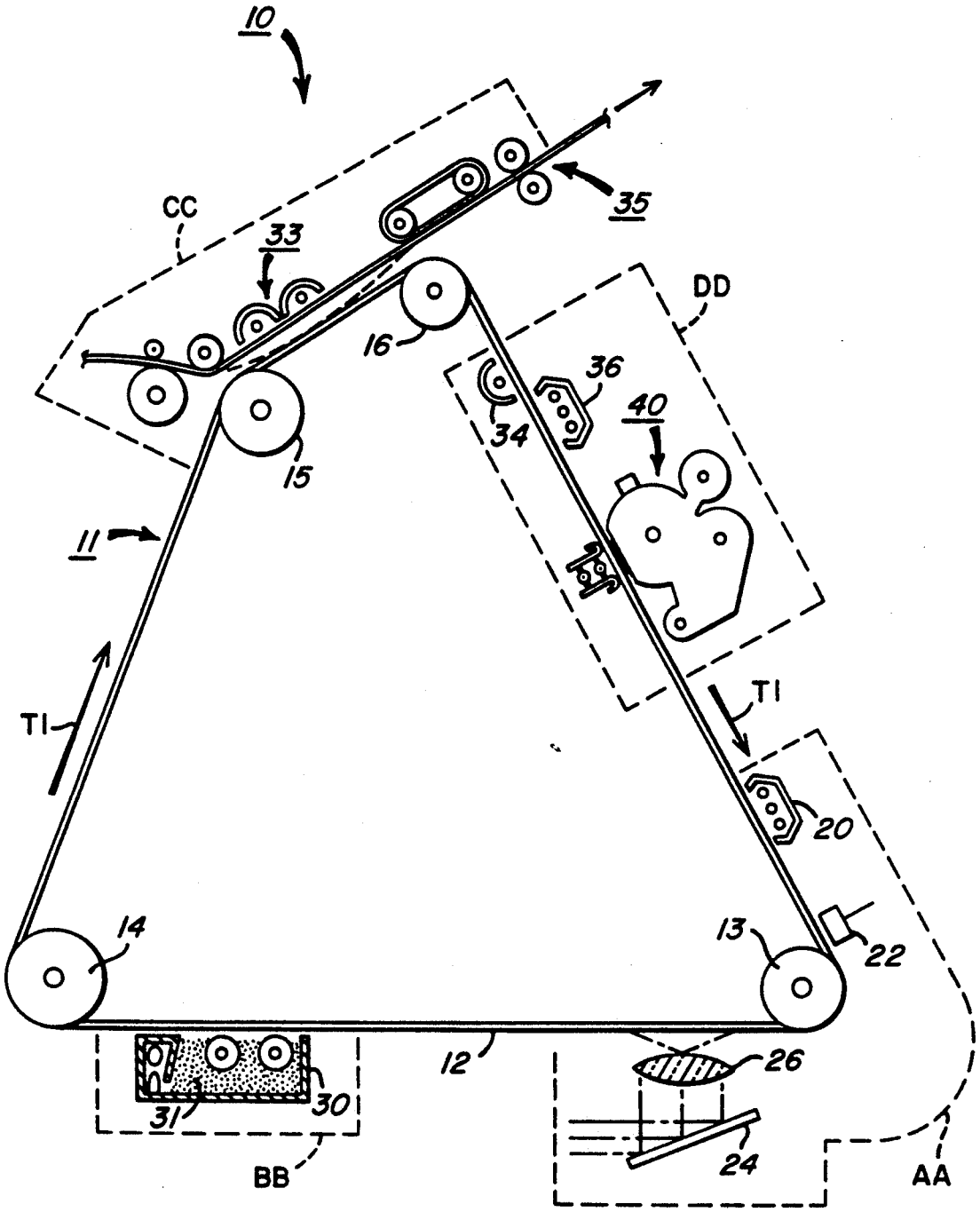
FIG. 1 is a schematic illustration of an electrostatographic reproduction machine such as an optical copier including the magnetic roller cleaning apparatus of the present invention.

Referring now to FIG. 1, an electrostatographic reproduction machine such as an optical copier is shown generally as 10, and includes an image-bearing member 11 which has a frontside image-bearing surface 12. As shown, the member 11 is trained about a series of roller 13 through 16 for movement in the direction, for example, of the arrow T1. One of the rollers, such as the roller 13, can be a drive roller, suitably driven by a conventional drive (not shown) for repeatedly moving the member 11 through a series of electrostatographic process stages shown as AA, BB, CC and DD. Although the member 11 is shown as an endless flexible web trained about the series of rollers, it should be understood that a rigid drum, having an image-bearing surface, can also be used.

As shown in FIG. 1, clean and charge-free portions of the image-bearing member 11 for example, initially move through the stage AA where electrostatic charges and/or light, are used in one manner or another (as is well known in the art) to electostatically form latent images of an original document on the surface 12. Typically, the stage AA includes contamination sensitive components such as a primary charger 20 or other charge depositing component (not shown). The electrostatic image of an original can thus be formed on the surface 12, for example, by charging the surface 12 using the primary charger 20, and then imagewise discharging portions of such surface using an electronic printhead 22 and/or an optical system. A typical optical system has a light source (not shown) that illuminates a document sheet, with the light rays from the sheet being reflected by a mirror 24 through a lens 26 to the surface 12.

The imaged portion of the image-bearing member 11 next moves to stage BB where the latent image thereon is developed, that is, made visible with charged particles of toner. Stage BB normally includes a development station 30 that contains a developer material 31 which may be comprised of toner particles only, or of a mixture of oppositely charged magnetic carrier particles and toner particles. In order to achieve high resolution development at this Stage BB, it is known to use such developer material 31 which may comprise fine toner particles and a carrier consisting of small, hard magnetic ferrite particles. Each such ferrite carrier particle is, of course, a magnet in itself, and thus possesses distinct N and S polarities. During development of the image at the station 30, the toner particles of the developer material 31 transfer to the image-bearing surface 12, and there adhere to the electrostatically formed image, thereby making the image thereon visible.

After such development, that portion of the image-bearing member 11 carrying the toner developed or visible image thereon, next moves to the stage CC. Stage CC usually includes an image transfer station 33 where the visible toner image on the surface 12 is transferred to a suitable receiver such as a sheet of paper that is fed in registration to the station 33 along a sheet travel path. Typically, such transfer is effected electrostatically as well as by contact and pressure within a transfer nip. After such image transfer, the copy sheet then travels to a fusing station 35, as shown, where the image is permanently fused to the receiver forming a copy, and the member 11 moves on about the series of rollers 13 through 16 towards the initial stage AA to begin another imaging cycle.

On leaving the transfer station 33, each portion of the surface 12 on which a toner image has been formed and transferred as described above ordinarily will be contaminated with residual charges as well as residual particles, principally residual toner particles. To ensure the continued production of high quality images and copies during subsequent cycles of the imaging process, it is necessary therefore to effectively clean, that is, remove such residual toner particles from each such used portion of the surface 12. Accordingly, such cleaning is carried out at stage DD where apparatus or devices are located for removing the residual charges and particles. As shown for example, the residual charges can be removed by a discharge lamp 34 and/or neutralized by a corona 36, and the residual toner particles can be removed by the magnetic roller cleaning apparatus of the present invention shown generally as 40.

Figure 2:
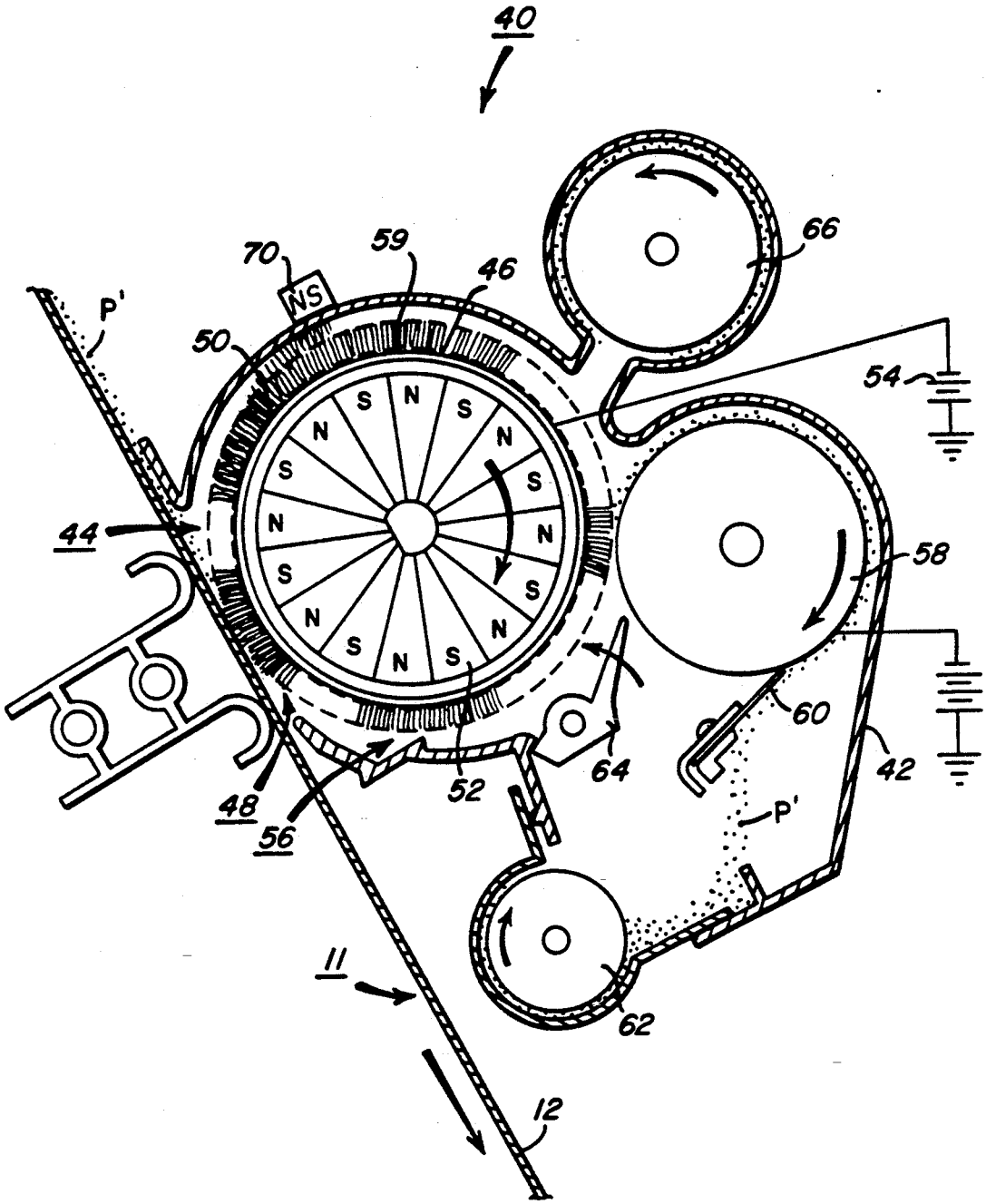
FIG. 2 is an enlarged illustration (partly in section) of the magnetic roller cleaning apparatus of FIG. 1 showing the magnetic nap mixing magnet of the present invention.

Referring now to FIG. 2, the magnetic brush or roller cleaning apparatus 40 is shown and comprises a housing 42 which as shown is metallic being made for example of aluminum which includes an opening 44 for mounting as shown in proximity to a moving surface such as the surface 12 being cleaned. The cleaning apparatus 40 also includes a rotatable magnetic roller 46 supported within and spaced from the housing 42 for forming a cleaning nip 48, through the opening 44, with the surface 12 being cleaned. The magnetic roller 46 as is well known may include a rotatable non-magnetic shell 50, a stationary magnetic core 52 located within the shell 50 and consisting of a plurality of alternating N and S pole magnets, and suitable drive means for rotating the shell 50 in a direction as shown by the arrow. An electrical bias source 54, for example, a negative D.C. source may be connected to the non-magnetic shell 50.

The magnetic cleaning apparatus 40 further comprises a magnetic cleaning material 56 being held and carried by the magnetic roller 46 within the space between such roller 46 and a detoning roller 58. The cleaning material 56 consist of magnetic carrier particles that are appropriately charged electrically to a polarity opposite the polarity of residual toner particles shown as P, on the surface 12. Because these charged carrier particles are magnetic as well, they can easily form a radially extending cleaning nap 59 on the surface of the non-magnetic shell 50 due to the magnetic influence thereon of the magnetic core 52. As is well known, the bottom portion of the nap 59 as formed is right on and near the surface of the shell 50, and the top portion thereof is extended radially away from such surface. The electrical source 54 thus biases the nap 59 to the same polarity as that of the shell 50.

Rotation of the non-magnetic shell 50, with the biased magnetic nap 59 being held magnetically thereon, brings the top portion of the nap 59 into pickup or cleaning contact with the surface 12 within the cleaning nip 48. The magnetic carrier particles of the nap 59, because they are charged oppositely to residual toner particles P' on the surface 12, attract and remove such particles P' from such surface 12.

Ordinarily, the shell 50 is rotated for example, clockwise from the nip 48 as shown in order to bring a portion of the nap 59, already laden with attracted residual toner particles, to the detoning roller 58. As shown, the detoning roller 58 is mounted adjacent but spaced from the magnetic roller 46, and is electrically biased appropriately so as to reattract and remove as much of the residual toner particles as possible out of the nap 59. Some residual toner particles, however, remain in the nap. Residual toner particles reattracted or detoned from the nap 59, as such, are then removed from the detoning roller 58 for example by means of a skive 60, and are subsequently transported by means for example of an auger 62 away from the cleaning apparatus 40 for eventual disposal or recycling to the developer apparatus. Ordinarily too, continued rotation of the shell 50 past the detoning roller 58 will again bring the supposedly detoned nap 59 into cleaning or residual toner removing contact within the cleaning nip 48 with the surface 12.

The cleaning process, as such, is repeated over and over until the effectiveness of the used or spent cleaning material 56 has declined significantly. At such time, a pivotable skive 64, which is shown spaced from or out of contact with the surface of the shell 50, is selectively pivoted into scraping contact with the surface of the shell 50 to scrape and remove therefrom all the spent or used cleaning material 56 now consisting of carrier particles and toner particles which together form the nap 59 thereon. The spent cleaning material 56 so scraped off falls onto the transport auger 62 and is similarly transported away from and out of the apparatus 40. Fresh or replenishment magnetic carrier particles can then be resupplied onto the magnetic roller 46 from a selective supply source of such particles shown as 66.

Unfortunately, however, it has been found that during rotation of the shell 50 from the cleaning nip 48 to the detoning roller 58, some of the residual toner particles attracted to the top portion of the oppositely charged nap 59 tend to settle towards the bottom portion of the nap. The detoning roller 58, however, is ordinarily not effective in removing such residual toner particles from or near the bottom portion of the nap. As a consequence, there is significant stratification of the nap with respect to detoning. Such stratification involves residual toner particles at the bottom portion of the nap remaining therein cleaning cycle after cleaning cycle thereby aging undesirably. Because of such stratification, the concentration of toner particles in the cleaning mix is much higher at the bottom portion near the surface of the shell 50 than at the top portion thereof. Additionally, the charge-to-mass ratio of cleaning mix particles thereat is detrimentally lowered and hence is their ability to effectively attract and remove additional residual toner particles from the surface 12. More importantly, it has been found that because of the undesirable aging of particles thereat, some of the aged residual toner particles actually experience a reversal in polarity thereby achieving a wrong-sign polarity for the proper functioning of the magnetic cleaning apparatus 40. Such wrong-sign toner particles then are repelled from the nap 59 of the roller 46, and undesirably redeposited back on the surface 12.

In accordance with the present invention, in order to overcome the above problems and associated disadvantages, the magnetic roller cleaning apparatus 40 further comprises nap mixing means shown as 70 which are mounted adjacent the magnetic roller 46 for disturbing the moving nap 59 thereon. Such disturbance, as such, causes a temporary bridging or blocking of the movement of the nap 59 thereby creating a radially mixing action between the bottom portion and the top portion of such nap. As shown, the nap mixing means 70 comprises a stationary magnetic member which is mounted externally on the housing 42. Preferably, the magnetic member 70 is coextensive with the axial length of the magnetic roller 46, and is mounted as shown upstream of the position of the detoning roller 58 relative to the direction of rotation of the non-magnetic shell 50. As such, the nap is mixed radially as above before the nap reaches the detoning roller 58.

The effectiveness and advantages of such a magnetic member 70 are verified for example in the following experimental examples:

EXAMPLE 1

A magnetic roller cleaning apparatus 40 was set up to run at 72 rpm, and was loaded with a cleaning mix 56 comprising 6% toner, and magnetic carrier particles made from passivated stainless steel coated with 0.1% KYNAR. A 160 V bias was put on the detoning roller 58 of the apparatus, and the magnetic cleaning roller 46 thereof was grounded. A nap mixing means 70, in the nature of a (3" axial length) 900 gauss magnet was put on the outside of the housing 42 of the cleaning apparatus in a first position as shown in FIG. 2. The cleaning apparatus 40 was run for six minutes. In a section of the magnetic cleaning roller 46 where the influence of the magnet 70 was not present, (the magnetic cleaning roller is 12" long), the nap 59 of the cleaning mix 56 appeared stratified, that is, the top portion of the cleaning nap 59 of the mix was detoned, but the bottom of the nap near the surface of the shell 50 of the magnetic cleaning roller 46 was stagnant and therefore not detoned. Samples were taken from the region (9") of the magnetic roller 46 that was not under the influence of the short (3") exterior magnet. The %TC (TC=toner concentration) in the top portion of the nap in this region was measured to be 0.3%, while the %TC at the bottom portion of the nap near the surface of the shell 50 was 2.5%. This is stratification. On the other hand, the %TC of the nap of the cleaning mix in the region under the influence of the short (3") exterior nap mixing magnet 70 appeared uniform, and showed no stratification. A sample taken from this region (3" of the 12" of the roller 46) was measured to have a substantially uniform 0.5%TC from the top to the bottom of the nap.

A short 3" exterior magnet was then placed in a second position (not shown in FIG. 2) downstream (that is after) the detoning roller 58, and in a section of the magnetic cleaning roller 46 that initially did not experience the influence of the 3" magnet in the first position (FIG. 2) during the first six minutes of running time. The apparatus was run and detoning was carried out for two more minutes. TC samples were taken from an area of the magnetic cleaning roller that did not experience the influence of the exterior magnet during either the first six minutes or the second two minutes and found to continue to exhibit significant stratification. The measurements in this case were 0.37%TC at the top of the nap, and 2.47%TC at the bottom of the nap near the shell surface. However, where the short exterior nap mixing magnet had been used, stratification was not evident, because the %TC measurements were substantially 0.8% top-to-bottom.

EXAMPLE 2

The progress of detoning with, and without, an exterior nap mixing magnet in a position as shown (FIG. 2) was monitored against time for the same materials 6% toner, and passivated stainless steel particles coated with 0.1% KYNAR. The cleaning apparatus was operated the same as in Example 1. For the no nap mixing magnet situation, the results are in Table I. For the nap mixing magnet situation (using a 12" long, 900 gauss exterior magnet), the result was clearly no observable stratification. The data are in Table II. The %TC versus time is compared as TC/TCO) (TCO is the measured %TC of the fresh mix 56; note that the measurement shows that all the residual toner particles are not removed). The conclusion is that the exterior nap mixing magnet leads to vertical or radial mixing of the nap, and therefore results in uniform detoning, and hence no concentration stratification.

TABLE I

Mix = 6% Toner with Passivated Stainless Steel particles coated with 0.1% KYNAR.

| NO MAGNETS | TC | TC | TC/TCO | |
|---|---|---|---|---|
| TIME | TOP | SHELL | TOP NAP | NEAR SHELL |
| 0 | 4.52 | 4.52 | 1 | 1 |
| 1 min | 1.30 | 3.46 | 0.288 | 0.765 |
| 6 | 0.34 | 2.03 | 0.075 | 0.449 |
| 20 | 0.08 | 3.15 | 0.021 | 0.697 |

TABLE II

| 5% Toner with magnet. | | |
|---|---|---|
| TIME | TC | TC/TCO |
| 0 | 4.49 | 1. |
| 1 | 2.96 | 0.659 |
| 2 | 2.11 | 0.470 |
| 5 | 1.85 | 0.412 |
| 10 | 0.98 | 0.218 |
| 15 | 0.75 | 0.167 |
| 20 | 0.55 | 0.122 |

EXAMPLE 3

The stratification of the nap of the cleaning mix, and the lowering of the charge/mass ratio of the toner particles in the stagnant zone (bottom of nap) near the shell is illustrated here in data from a full process test. The cleaning or carrier particles are the same composition as in Examples 1 and 2. Table III shows the %TC and charge (mc/g) of the cleaning mix near the shell and at the top of the nap as a function of thousands of copies made with a 30% takeout document. The cleaning apparatus did not employ the mixing magnet 70 and the bottom portion of the nap near the shell holds more toner which is lower in charge/mass ratio. The ratio is so low that negative or wrong sign toner is easily created which can then be repelled by the cleaning apparatus back onto the photoreceptor 12.

TABLE III

| Full Process Test | | | | |
|---|---|---|---|---|
| Thousands | TOP OF NAP | | NAP NEAR SHELL | |
| of Prints | % TC | m c/g | % TC | m c/g |
| 10 | 1.1 | 13.9 | 2.1 | 1.2 |
| 15 | 1.0 | 11.5 | 2.0 | 2.1 |
| 20 | 1.2 | 13.8 | 2.5 | 0.8 |

EXAMPLE 4

The following example illustrates how wrong sign toner can be generated, by simply shaking a mixture of toner particles and oppositely charged carrier particles. A mix was prepared at 2% TC, the charge/mass ratio was 6.2 m c/g, 1.83% developed during the test. After 15 minutes of shaking (on a wrist shaker device) the charge/mass ratio was 2.0 m c/g, 1.23% developed with 0.44% developing at −5.9 m c/g. Note that the unshaken material was positive polarity only. Thus, if the toner spends a prolonged period of time in the cleaning mix, it can become reversed in polarity. The toner at the bottom of the nap near the shell in the stratified case without the magnets is thus subject to this phenomena.

The nap mixing means 70, for example, can be a permanent magnet as used in the above examples. However, it should be understood that any means for generating a magnetic field between the housing 42 and magnetic roller 46 sufficient to create temporary bridging or blocking of the movement of the nap 59 will suffice. A non-magnetic means such as a mechanical skive mounted upstream of the detoning roller in scraping engagement with the magnetic roller 46 may also suffice provided the magnetic influence of the core magnets is sufficient to reattract the disturbed nap unto the shell 50.

While the invention has been described with regard to electrostatographic reproduction machines such as copiers and printers and the cleaning of a photoreceptor, other types of surfaces to be cleaned of toner particles are of course also contemplated.

The invention has been described in detail with particular reference to a presently preferred embodiment, but it will be understood that variations and modifications can be effected within the spirit and scope of the invention.

What is claimed is:

1. A magnetic roller cleaning apparatus for removing residual toner particles from a surface in an electrostatographic reproduction machine, the magnetic roller cleaning apparatus comprising:

(a) a housing;

(b) means, including a rotatable magnetic roller, for moving a nap of a magnetic cleaning mix in said housing, said magnetic roller including an electrical biasing source and forming a cleaning nip with the surface being cleaned;

(c) a detoning member for removing residual toner particles from the nap of the magnetic cleaning mix; and (d) nap mixing means, mounted externally to said housing and spaced from said magnetic roller, upstream of said detoning member and downstream of said cleaning nip relative to the direction of rotation of said magnetic roller and forming a nap travel path with said magnetic roller such that said nap is moved between said magnetic roller and said nap mixing means, for temporarily blocking and therefore disturbing the nap of cleaning mix on said magnetic roller thereby creating a mixing action between a bottom portion and a top portion of such nap on said magnetic roller prior to detoning.

2. The magnetic roller cleaning apparatus of claim 1 wherein said nap mixing means comprises a magnetic member.

3. The magnetic roller cleaning apparatus of claim 2 wherein said magnetic member is stationary.

4. A magnetic roller cleaning apparatus for removing residual toner particles from a surface in an electrostatographic reproduction machine, the magnetic roller cleaning apparatus comprising:

(a) a housing mountable in proximity to the surface being cleaned, said housing including an opening;

(b) means including a rotatable magnetic roller supported within said housing for forming a cleaning nip through said opening with the surface being cleaned;

(c) a nap of magnetic cleaning material for contacting the surface being cleaned to remove charged residual toner particles from such surface, said nap having a bottom portion on the surface of, and a top portion extending radially away from said rotatable magnetic roller;

(d) a biased detoning roller mounted adjacent said magnetic roller for removing attracted residual toner particles from said nap; and (e) nap mixing means mounted external to said housing and said magnetic roller, upstream of said detoning roller and downstream of said cleaning nip relative to the direction of rotation of said magnetic roller, and forming a nap travel path with said magnetic roller such that said nap is moved between said magnetic roller and said nap mixing means, for temporarily blocking and therefore disturbing said nap and creating a mixing action between said bottom portion and said top portion of said cleaning nap on said magnetic roller prior to detoning.

5. The magnetic roller cleaning apparatus of claim 4 wherein said nap mixing means comprises a magnetic member.

6. The magnetic roller cleaning apparatus of claim 5 wherein said magnetic member is stationary.

7. The magnetic roller cleaning apparatus of claim 4 wherein said nap mixing means is mounted on said housing at a location where said housing forms a nap-bridgeable path with said rotatable magnetic roller for transporting said nap of magnetic cleaning material.

8. The magnetic roller cleaning apparatus of claim 4 wherein said biased detoning roller is mounted such as to directly contact a nap of magnetic cleaning material being carried on the surface of said rotatable magnetic roller past said detoning roller.

9. The magnetic roller cleaning apparatus of claim 4 including a pivotable blade member having a first position spaced from, and a selectable second position in contact with, the surface of said rotatable magnetic roller for selectively scraping off a spent nap of magnetic cleaning material thereon used in cleaning a surface.

10. The magnetic roller cleaning apparatus of claim 9 including a supply source within said housing for supplying fresh magnetic cleaning material onto said rotatable magnetic roller.

* * * * *